US007467672B2

(12) United States Patent
Cruickshank

(10) Patent No.: US 7,467,672 B2
(45) Date of Patent: Dec. 23, 2008

(54) ORIENTATION TOOL

(75) Inventor: Brian Cruickshank, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 307 days.

(21) Appl. No.: 11/418,578

(22) Filed: May 5, 2006

(65) Prior Publication Data

US 2007/0256865 A1 Nov. 8, 2007

(51) Int. Cl.
*E21B 7/04* (2006.01)

(52) U.S. Cl. ..... 175/61; 175/45; 175/73; 175/106

(58) Field of Classification Search ..... 175/61, 175/73, 106, 256, 45
See application file for complete search history.

(56) References Cited

U.S. PATENT DOCUMENTS

| | | | | |
|---|---|---|---|---|
| 5,311,952 | A | 5/1994 | Eddison et al. | |
| 5,316,094 | A | 5/1994 | Pringle | |
| 5,373,898 | A | 12/1994 | Pringle | |
| 5,409,060 | A | 4/1995 | Carter | |
| 5,425,417 | A | 6/1995 | Carter | |
| 5,441,119 | A | 8/1995 | Head et al. | |
| 5,443,129 | A | 8/1995 | Bailey et al. | |
| 5,450,914 | A * | 9/1995 | Coram | 175/73 |
| 5,669,457 | A * | 9/1997 | Sebastian et al. | 175/73 |
| 5,894,896 | A | 4/1999 | Smith et al. | |
| 6,279,659 | B1 | 8/2001 | Brunet | |
| 6,315,054 | B1 | 11/2001 | Brunet | |
| 6,419,014 | B1 | 7/2002 | Meek et al. | |
| 6,439,321 | B1 * | 8/2002 | Gillis et al. | 175/73 |
| 6,510,898 | B1 | 1/2003 | Buytaert | |
| 6,536,531 | B2 | 3/2003 | Brunet | |
| 6,827,148 | B2 | 12/2004 | Shaw et al. | |
| 6,955,231 | B1 | 10/2005 | Bakke et al. | |
| 7,287,607 | B1 * | 10/2007 | Falgout, Sr. | 175/61 |
| 7,360,609 | B1 * | 4/2008 | Falgout, Sr. | 175/61 |
| 2002/0070018 | A1 | 6/2002 | Buyaert | |

FOREIGN PATENT DOCUMENTS

| | | |
|---|---|---|
| WO | 9507404 | 3/1995 |
| WO | 9730262 | 8/1997 |

OTHER PUBLICATIONS

Combined Search and Examination Report dated Aug. 10, 2007 for Application No. GB0708515.2.

* cited by examiner

*Primary Examiner*—Shane Bomar
(74) *Attorney, Agent, or Firm*—Osha · Liang LLP

(57) ABSTRACT

An orienting apparatus including at least one housing element configured to couple with a drill string; an actuator disposed inside the at least one housing element; a nozzle coupled to the actuator; a torque generator coupled to the actuator and extending axially downward through the at least one housing, wherein the torque generator is configured to rotate in a first direction as it moves downward; a mandrel coupled to the torque generator; and a stroke adjuster at least partially disposed in an upper end of the mandrel, wherein rotation in the first direction is caused by an increase in differential pressure is disclosed.

20 Claims, 6 Drawing Sheets

ORIENTATION TOOL

BACKGROUND OF INVENTION

1. Field of the Invention

The invention relates generally to directional drilling tools. In particular, the invention relates to directional drilling tool that are used to control the direction of drilling of bore holes.

2. Background Art

Increasingly, the drilling of oil and gas wells is no longer a matter of drilling vertically straight boreholes. Changes in the direction of drilling of boreholes are required for a number of reasons. The most frequent reason is to change from vertical drilling to horizontal drilling or drilling at any angle therebetween. Horizontal drilling has been known for many years and there are a number of established methods of changing the direction from vertical drilling to horizontal drilling. Technology and techniques have now been developed to change the angle of the bore's trajectory by up to and sometimes exceeding 90 degrees from the vertical. Directional drilling using coiled tubing rather than jointed pipe can offer numerous advantages compared to conventional drilling including new approaches to oil and gas traps having non-conventional geometries, economic zone enhancement as can occur, for example, if the borehole is deviated to actually follow an oil or gas bearing strata, improved economics particularly in an under-balanced environment (when formation pressure is sufficient to force hydrocarbons to the surface at potentially explosive rates) and reduced environmental degradation.

The most common existing method to change the direction of drilling is to use a bent support (often called a "bent sub") for the drill bit. Typically a drill bit powered by a motor is used with a bent sub positioned behind the motor. It is also possible for the bent sub to be positioned in front of the motor. The bent sub effectively causes the axis of rotation of the drill be to be at a different angle to that of the drill pipe. Continuous drilling with the bent sub causes continuous changes of direction which results in a curved well hole in the direction of the bend of the bent sub. When the required curvature has been achieved drilling can be stopped and the bent sub changed for a straight sub to resume straight drilling. Alternatively, the entire drill pipe can be rotated at the surface resulting in a small rotation of the bent sub, motor and drill bit assembly. In that case, the bend of the bent sub will be positioned in a different direction and drilling can be resumed in a different direction. Positional sensors such as gyroscopic sensors are often used to check the progress and direction of the drilling to establish what adjustments to the drilling angle are required.

After deviating a borehole from the vertical, it is not typically practical to sustain continuous drilling operations by rotating the drill string in order to also rotate the bit. Preferably only the bit is rotated by a downhole motor attached to the lower end of the drill pipe. The motor typically includes a rotor-stator that generates torque as drilling fluid passes between the rotor and stator. A bent sub may be positioned behind or in front of the motor. As discussed above, the bent sub deviates the hole by the required amount and may surround a drive shaft that transmits the rotor/stator's torque to a bearing assembly.

Electronics supported in the bottomhole assembly and connected to the surface by a wire line passing through the interior of the drill string can transmit information with respect to the amount of curvature in the borehole's trajectory so that it may be plotted. Once the required curvature has been attained so that the axis of the bit's rotation is pointed in the desired direction, the drilling is stopped and the motor is withdrawn from the well. The bent housing is then either removed or straightened (if it is of the adjustable sort) and the motor is tripped back into the hole to resume drilling. Each time the motor requires service, or a change in the hole's direction is required, this process must be repeated. This results in substantial costs and down time largely due to the time required to make and break all of the joints as the drill string is tripped in and out of the hole. For this reason, jointed drill pipe is now being replaced whenever possible with coiled tubing.

To drill a short radius or medium radius wellbore it is desirable to be able to drill with relative precision along desired or predetermined wellbore paths ("wellbore profiles"), and to alter the drilling direction downhole without the need to retrieve the drilling assembly to the surface. Sufficient torque is needed to rotate the bent sub, drill bit, and any downhole tools disposed below the orienting tool. Drilling assemblies for use with coiled tubing to drill wellbores in the manner described above, preferably need a dedicated orienting device. The orienting device may be located near the drill bit for orienting and controlling the drill bit while drilling the wellbore. The device should be operable during drilling of the wellbore to cause the drill bit to alter the drilling direction.

In addition to controlling the bend angle in the coil tubing, it is also necessary to orient the bend point to control and adjust the borehole's bearing or azimuth. Examples of orienting tools for controlling azimuth are disclosed in U.S. Pat. Nos. 6,955,231, 5,894,896, and 5,441,119.

U.S. Pat. No. 6,955,231 describes a tool for changing the direction of drilling during drilling positioned between drill string and a bent sub. The tool includes at least two housing elements connected to one another, a passage for drilling fluid, a valve adapted for choking the passage so that the tool can be activated for rotation, and a piston adapted for forced guiding of the rotation. Twisted splines may be formed in the wall of the passage and in the wall of the opposite piston to guide rotation of the piston. The tool is activated for rotation by increasing the pressure of the fluid passing through the tool. The rotation ends by relief of the pressure of the fluid. The tool rotation is infinitely variable and is only regulated by monitoring magnetic measurements recorded by measurements-while-drilling (MWD) instruments and techniques.

U.S. Pat. No. 5,894,896 describes an apparatus for azimuthal orientation of a tool in a wellbore. The apparatus includes a tubular housing, a mandrel rotatably supported in the tubular housing and extending therefrom for connection to a toll for rotation, a piston mandrel axially aligned with and connected to the mandrel, and a piston longitudinally movable in an annulus between the piston mandrel and the tubular housing that is non-rotatable relative to the tubular housing. At least one pin is longitudinally movable in concert with the piston arranged to track in respective helical grooves in the mandrel. A flow path selectively delivers pressurized hydraulic fluid to either side of the piston for rotating the mandrel or to both sides of the piston equally to maintain a fixed annular orientation. The orienting tool is independently controlled from the mud flow rate.

U.S. Pat. No. 5,441,119 describes a directional drilling system including a directional drilling tool that has two parts moveable relative to each other in the horizontal or vertical planes. Cam surfaces are provided between the two parts for adjustments to the drilling direction in the vertical plane. A slot and groove mechanism is provided between the two as an example of adjustments in the horizontal plane. The cam surfaces are contoured such that, when the piston and inner parts are rotated with respect to each other, an inner part is adjusted to a position which is off line with respect to the original center line and the center of the drill pipe. Thus, the entire orienting device rotates and moves off center of the drill pipe.

Accordingly, there exists a need for an orienting apparatus that provides sufficient torque output to downhole tools disposed below (further downhole) the orienting apparatus. There also exists a need for an orienting apparatus that allows controlled, accurate rotation of the apparatus, and therefore downhole tools located below the orienting apparatus, from the surface.

SUMMARY OF INVENTION

In one aspect, the present invention relates to an orienting apparatus comprising at least one housing element configured to couple with a drill string; an actuator disposed inside the at least one housing element; a nozzle coupled to the actuator; a torque generator coupled to the actuator and extending axially downward through the at least one housing, wherein the torque generator is configured to rotate in a first direction as it moves downward; a mandrel coupled to the torque generator; and a stroke adjuster at least partially disposed in an upper end of the mandrel, wherein rotation in the first direction is caused by an increase in differential pressure.

Other aspects and advantages of the invention will be apparent from the following description and the appended claims.

DETAILED DESCRIPTION

In one aspect, embodiments of the invention relate to an orienting apparatus that provides variable torque output for rotating downhole tools disposed below the orienting apparatus. In another aspect, embodiments of the invention relate to an orienting apparatus for changing the azimuthal orientation of a tool in a wellbore. In another aspect, embodiments of the invention relate to an orienting apparatus that provides controlled incremental rotation of the orienting apparatus, and therefore, of downhole tools disposed below the orienting apparatus. In another embodiment, the apparatus provides adjustable rotation of the tool in the wellbore during operation, while maintaining torque output.

Figure 1:
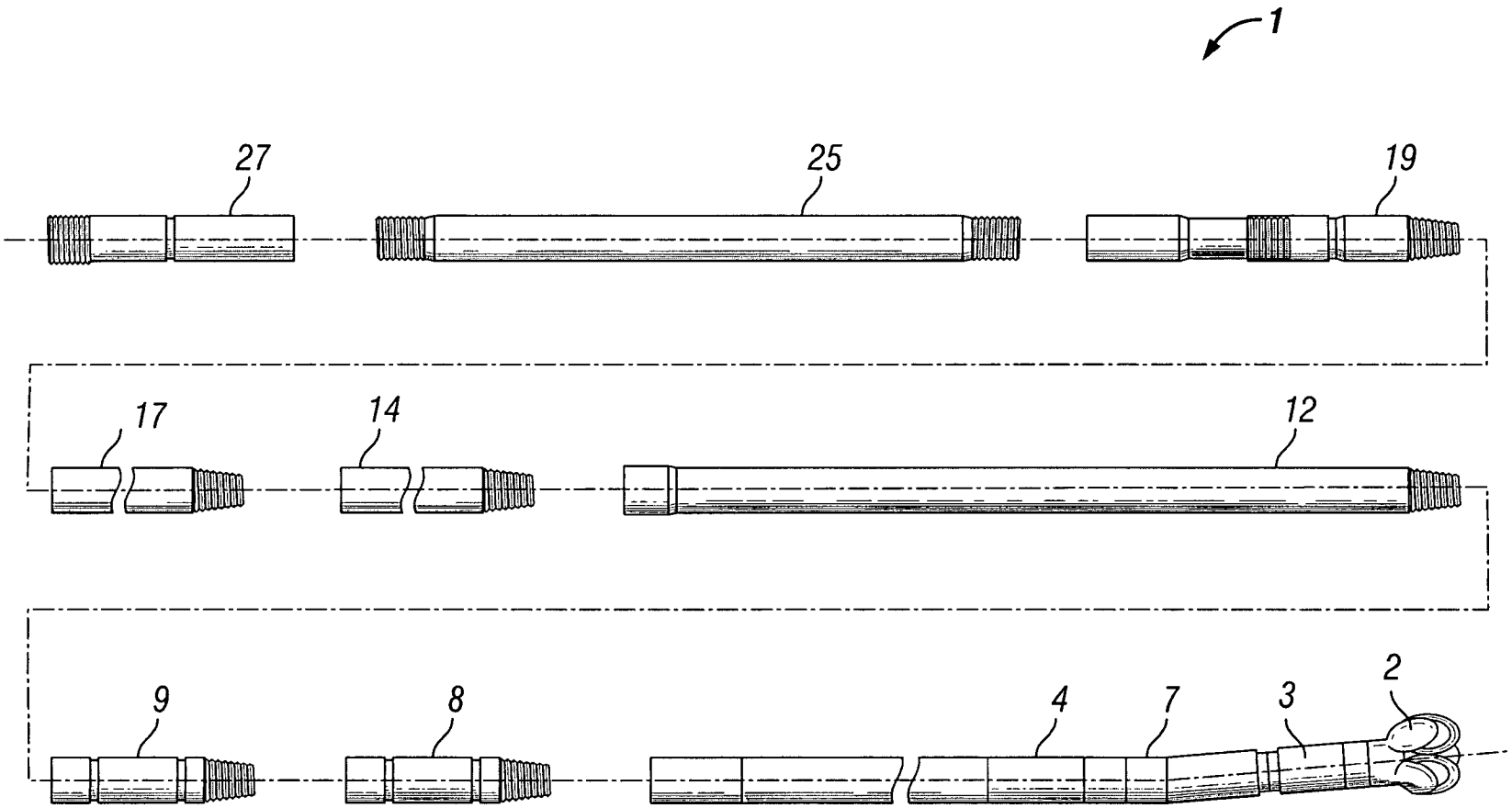
FIG. 1 is a diagrammatic view of a bottomhole assembly including an orienting apparatus.

FIG. 1 shows a diagram of a typical bottom hole assembly (BHA) 1 of tools suspended from the terminal end of coiled tubing (not shown) for directional drilling of oil and gas wells. The BHA in FIG. 1 includes a bit 2, a bearing assembly 3, a positive displacement motor (PDM) 4 with a bent housing (bent sub) 7, non-magnetic float subs 8 and 9, non-magnetic collar 12 including MWD sensors (not shown), downhole pressure sub 14, a non-magnetic collar 17 for non-magnetic spacing, a coiled tubing quick disconnect 19 for release of the BHA should it become stuck in the hole, orienting apparatus 25, and a coiled tubing connector 27 for connecting the BHA to the coil tubing terminus. One of ordinary skill in the art will appreciate that orienting apparatus 25 may also be disposed on jointed pipe.

Figure 2:
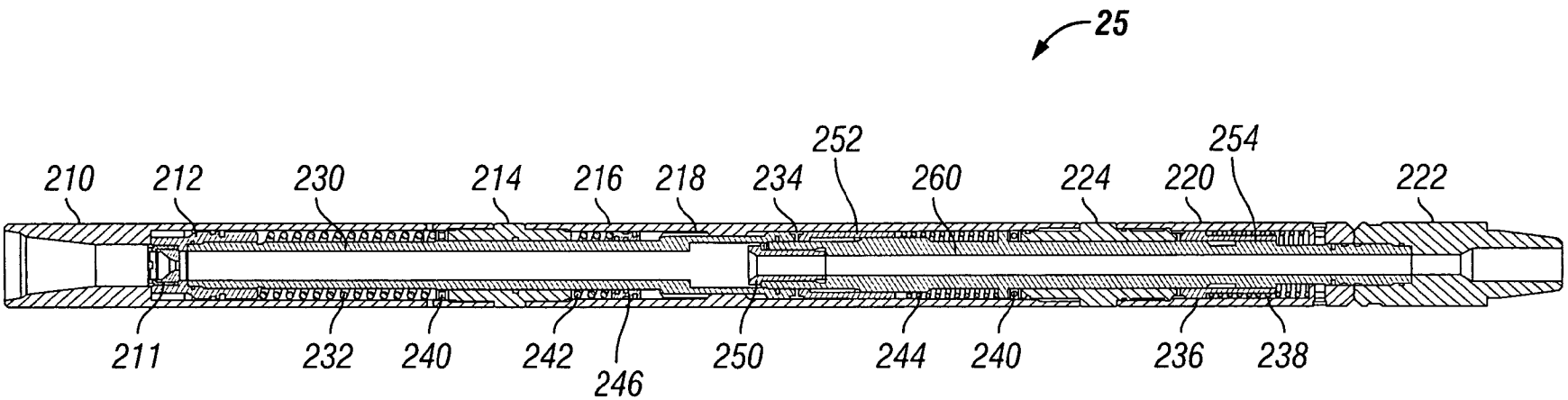
FIG. 2 is a cross-sectional view of an orienting apparatus in accordance with an embodiment of the invention.

As shown in FIG. 2, the orienting apparatus 25 includes at least one housing element. In one embodiment, orienting apparatus 25 includes three housing elements 210, 216, and 220. In this embodiment, an upper end of a first housing element, or piston housing, 210 is configured to couple with the drill string (not shown). A lower end of piston housing 210 is coupled to an upper end of upper body 214 and an upper end of a second housing, or spline housing, 216 is coupled to a lower end of upper body 214. A lower end of spline housing 216 is coupled to an upper end of lower body 224 and an upper end of a third housing, or end cap, 220 is coupled to a lower end of lower body 224. A bottom sub 222 is coupled to a lower end of the orienting apparatus 25, axially below the end cap 220. The connections between the housing elements 210, 216, 220 and upper and lower bodies 214, 224 may be, for example, threaded connections. The threaded connections between the housing elements 210, 216, 220 and upper and lower bodies 214, 224 may be pressure-tight by means of a seal 217 provided between the housing elements 210, 216, 220 and the upper and lower bodies 214, 224. A bore through the center of the orienting apparatus 25 provides a passage for fluid for actuation of the orienting apparatus 25. One of ordinary skill in the art will appreciate that the number of housing elements may vary without departing from the scope of the invention. For example, piston housing 210 and spline housing 216 may be combined and formed as a single housing element. Alternatively, spline housing 216 and end cap 220 may be formed as a single housing element.

In the embodiment shown in FIG. 2, piston housing 210 includes a piston 212 disposed on an upper end of a torque generator 230. One of ordinary skill in the art will appreciate that piston 212 may be any actuator known in the art. In one embodiment, torque generator 230 may be a cylindrical body formed with a passage for fluid therethrough. Piston 212 may be coupled to torque generator 230 by any method known in the art. In one embodiment, piston 212 may be threadedly engaged with torque generator 230. Alternatively, piston 212 may be coupled to torque generator 230 by bolts or an adhesive. In yet another embodiment, piston 212 may be integrally formed with torque generator 230.

Figure 3:
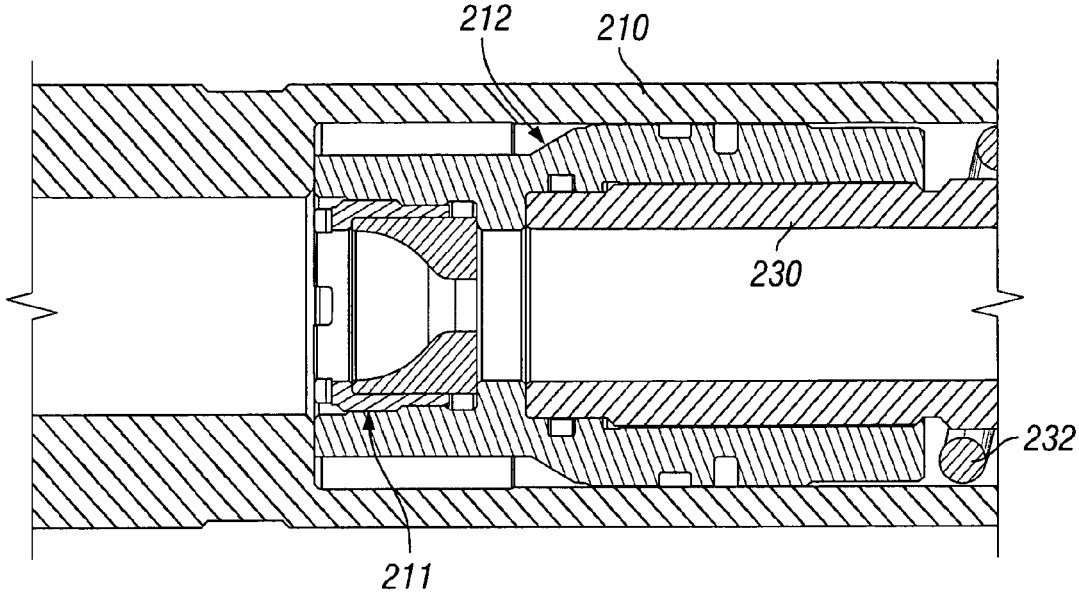
FIG. 3 is a partial cross-sectional view of an orienting apparatus in accordance with an embodiment of the invention.

As shown in greater detail in FIG. 3, a nozzle 211 is coupled to an upper end of piston 212. In one embodiment, nozzle 211 may disposed inside the upper end of piston 212. The nozzle 211 may be removable and interchangeable with another nozzle at the surface in order to provide a pre-determined pressure drop across the nozzle 211. Thus, the nozzle 211 may be selected so that the orienting tool 25 activates at a pre-determined flow rate of fluid through nozzle 211. In one embodiment, nozzle 211 may be threadedly engaged with piston 212. One of ordinary skill in the art will appreciate that the nozzle 211 may be coupled with piston 212 by any means known in the art so long as the nozzle 211 may be uncoupled or removed from piston 212. In another embodiment, nozzle 211 may be integrally formed with piston 212, such that, nozzle 211 may be changed by removing piston 212. The removed piston 212 may then be replaced with a new piston having a new nozzle of a different shape and/or size. The nozzle 211 may be selected in accordance with a desired torque output to be generated by the orienting apparatus 25. For example, the size and shape of nozzle 211 may be selected based on the type of fluid used to activate the orienting apparatus 25 and the pump rate at which the fluid is pumped through the nozzle 211. Depending on, for example, the density and/or the viscosity of the fluid delivered through nozzle 211 at a given flow rate, a nozzle 211 may be selected so as to provide a sufficient differential pressure across the nozzle 211 for a desired torque output of the orienting apparatus 25. Accordingly, the torque output by the orienting apparatus 25 may be varied by changing the nozzle 211 coupled to piston 212.

Below the piston 212, a piston return spring 232 is disposed around torque generator 230. A thrust bearing 240 may be disposed around torque generator 230 between a lower end of the piston return spring 232 and an upper end of upper body 214. Torque generator 230 extends downward through upper body 214 and into spline housing 216.

Figure 4:
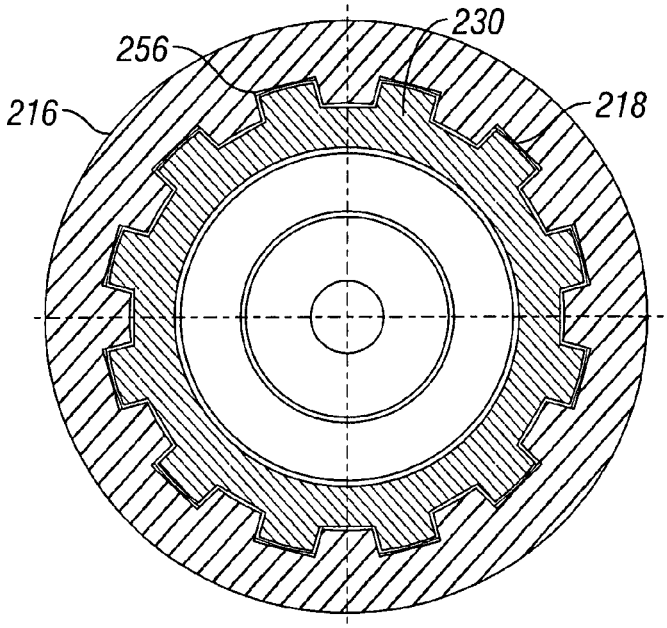
FIG. 4 is a cross-sectional view of an orienting apparatus in accordance with an embodiment of the invention.

Spline housing 216 includes a lower end of torque generator 230, a mandrel 260, an upper clutch 234, and an upper clutch spring 240. A compensator spring 242 and a compensator piston 246 are disposed around torque generator 230, below upper body 214. At least one helical spline 218 is formed on an outside diameter of a lower end of torque generator 230. As shown in more detail in a cross-sectional view of FIG. 4, corresponding helical grooves 256 formed on an inside diameter of spline housing 216 align with the at least one helical spline 218. The at least one helical spline 218 is formed such that when the torque generator 230 moves downward, as indicated by arrow D, at least one helical spline 218 moves downward within corresponding helical grooves 256 and rotates torque generator 230. In one embodiment, the at least one helical spline 218 and the corresponding helical grooves 256 are formed so that when the torque generator 230 moves downward, it rotates in a clockwise direction (as viewed from above). In another embodiment, the at least one helical spline 218 and corresponding helical grooves 256 are formed so that when the torque generator 230 moves downward, it rotates in a counter-clockwise direction (as viewed from above).

Figure 5:
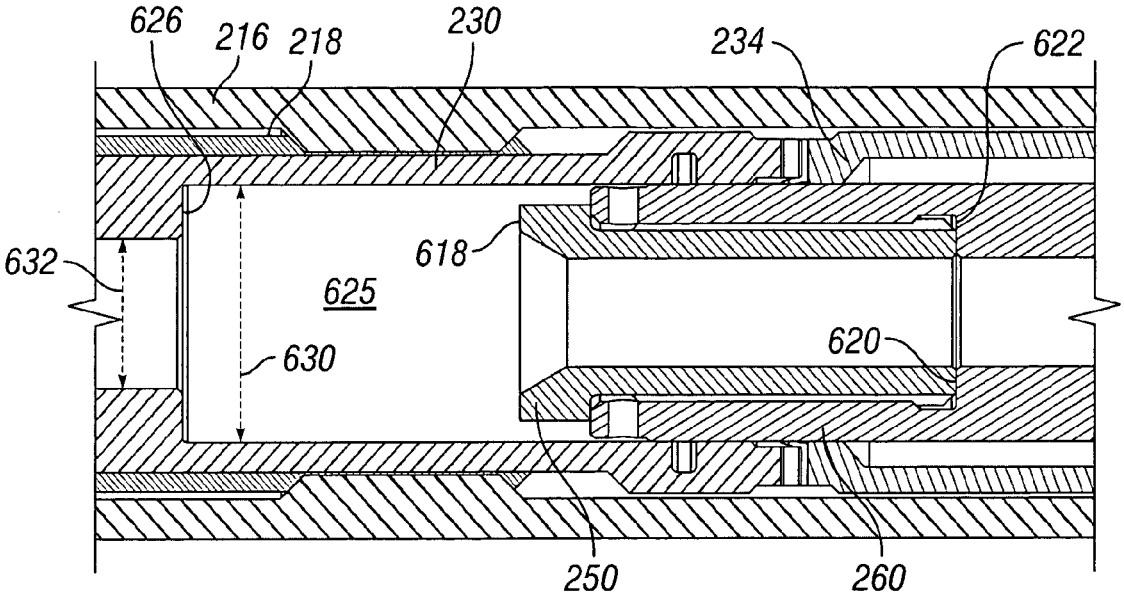
FIG. 5 is a partial cross-sectional view of an orienting apparatus in accordance with an embodiment of the invention.

Referring now to FIG. 5, an inside diameter 630 of a lower end of torque generator 230 is larger than an inside diameter 632 of an upper end of torque generator 230, thereby forming a stop 626. An upper end of mandrel 260 is disposed inside the lower end of torque generator 230 within larger inside diameter 630. A stroke adjuster 250 is disposed radially inside torque generator 230 and disposed at least partially inside the upper end of mandrel 260. In one embodiment, stroke adjuster 250 may be threaded inside the mandrel 260. In one embodiment, a lower surface 620 of stroke adjuster 250 contacts a shoulder 622 formed on an inside diameter of mandrel 250. In another embodiment, stroke adjuster 250 may be partially threaded within mandrel 260. That is, lower surface 620 of stroke adjuster 250 may not contact shoulder 622 of mandrel 260.

A pre-determined axial length of space 625 is provided between stop 626 and an upper surface 618 of stroke adjuster 250. The axial length of space 625 limits the downward movement of torque generator 230. The downward movement, and therefore degree of rotation, of torque generator 230 may be pre-selected by selecting a corresponding axial length of space 625 between stop 626 and upper surface 618 of stroke adjuster 250. When assembling the orienting apparatus 25 at the surface of the well, the amount of downward movement of the torque generator 230 may be selected by inserting the stroke adjuster 250 a selected distance within mandrel 260, thereby providing a selected axial length of space 625 between stop 626 and upper surface 618 of stroke adjuster 250. The axial length of space 625 corresponds to a degree of rotation of the orienting tool 25, and in particular the mandrel 260. Accordingly, each stroke of the piston 212 corresponds to a pre-determined degree of rotation of mandrel 260.

Figure 6:
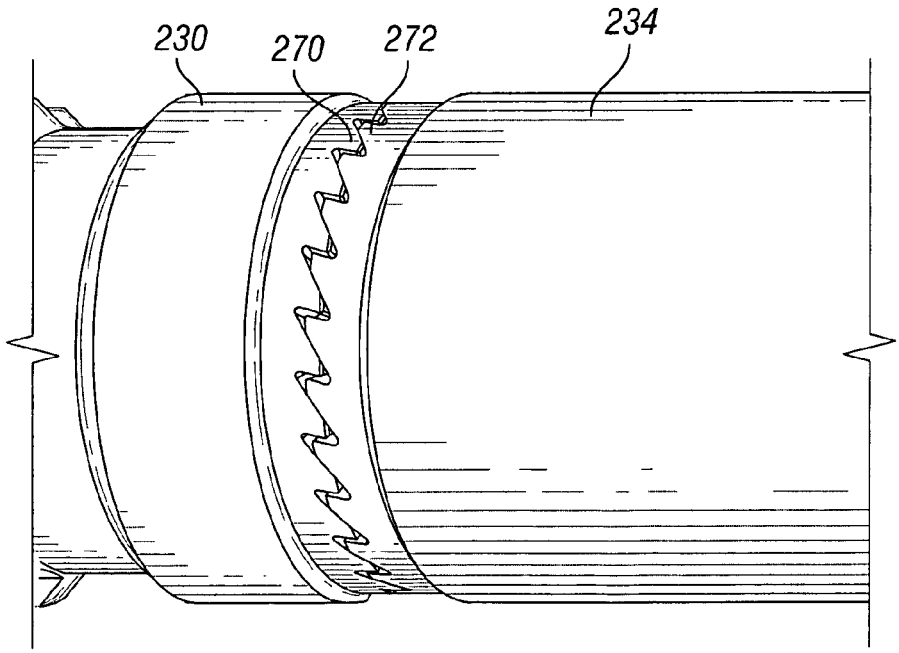
FIG. 6 is a partial perspective view of an orienting apparatus in accordance with an embodiment of invention.
Figure 7:
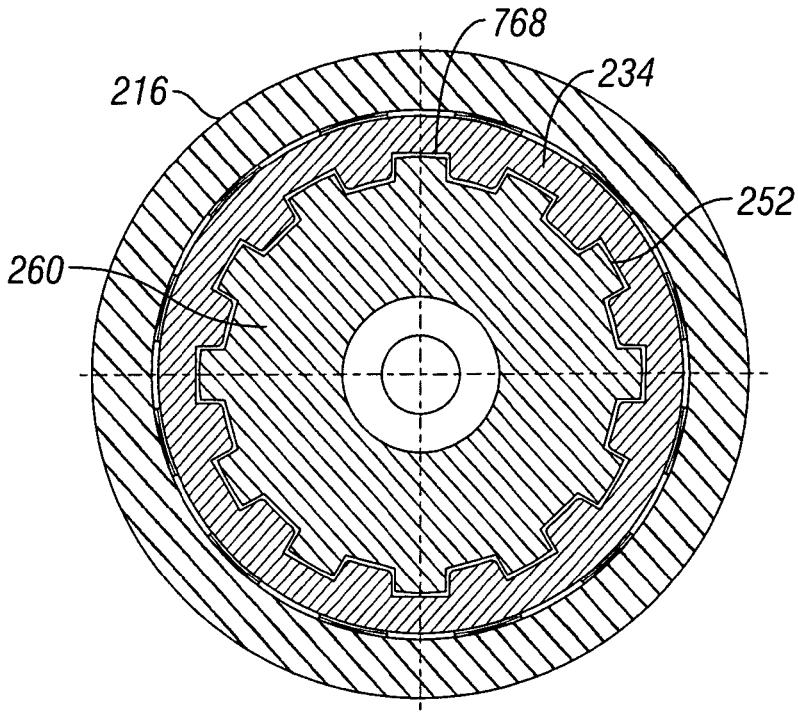
FIG. 7 is a cross-sectional view of an orienting apparatus in accordance with an embodiment of the invention.

Referring now to both FIGS. 5 and 6, upper clutch 234 is disposed around an upper end of mandrel 260, axially below torque generator 230. A plurality of teeth 270 formed on a bottom surface of the torque generator 230 is configured to engage a plurality of teeth 272 formed on an upper surface of upper clutch 234. The plurality of teeth 270 of torque generator 230 and the plurality of teeth 272 of upper clutch 234 are biased so that when engaged, the upper clutch 234 may be moved in one direction. For example, in the embodiment shown in FIG. 6, as torque generator 230 rotates clockwise due to helical splines 218 (FIG. 2), teeth 270 engage with teeth 272 of upper clutch 234, thereby rotating upper clutch 234 clockwise. As shown in FIG. 7, a plurality of straight splines 252 disposed on an outside diameter of mandrel 260 engage corresponding grooves 768 formed on an inside diameter of upper clutch 234. Therefore, as the plurality of teeth 271 on torque adjuster 230 engage the plurality of teeth 272 of upper clutch 234 and rotate the upper clutch 234, engagement of straight splines 252 and corresponding grooves 768 rotate the mandrel 260 in a clockwise direction. One of ordinary skill in the art will appreciate that other ratcheting mechanisms may also be used without departing from the scope of the invention.

Figure 8:
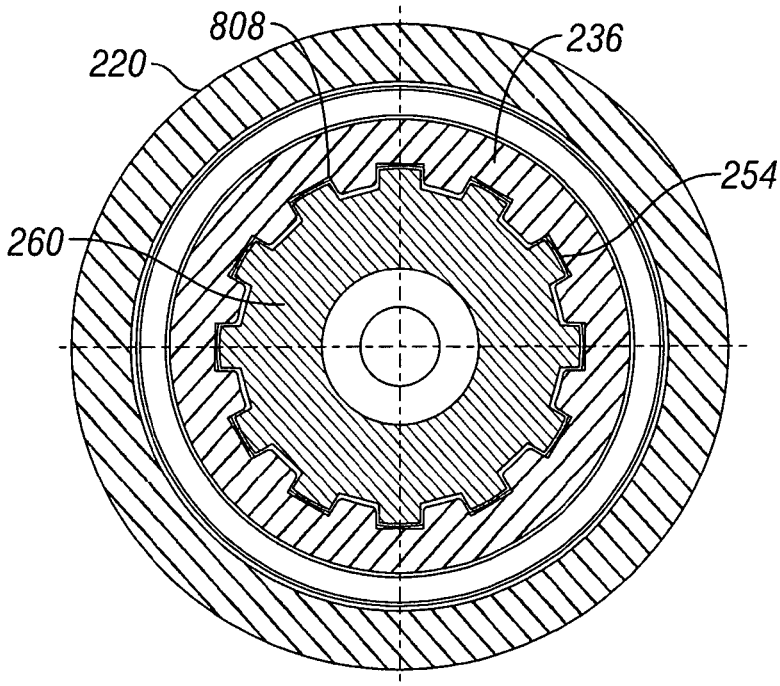
FIG. 8 is a cross-sectional view of an orienting apparatus in accordance with an embodiment of the invention.

Referring back to the embodiment shown in FIG. 2, the mandrel 260 extends downward through lower body 224 and end cap 220 into bottom sub 222. Within end cap 220, a lower clutch 236 is disposed around mandrel 260 below lower body 224. As shown in FIG. 8, a plurality of straight splines 254 formed on a lower end of mandrel 260 engage a plurality of corresponding grooves 808 formed on an inside diameter of lower clutch 236. As the mandrel 260 rotates in response to rotation of torque generator 230, engagement of straight splines 254 with corresponding grooves 808 rotate lower clutch 236.

Figure 9:
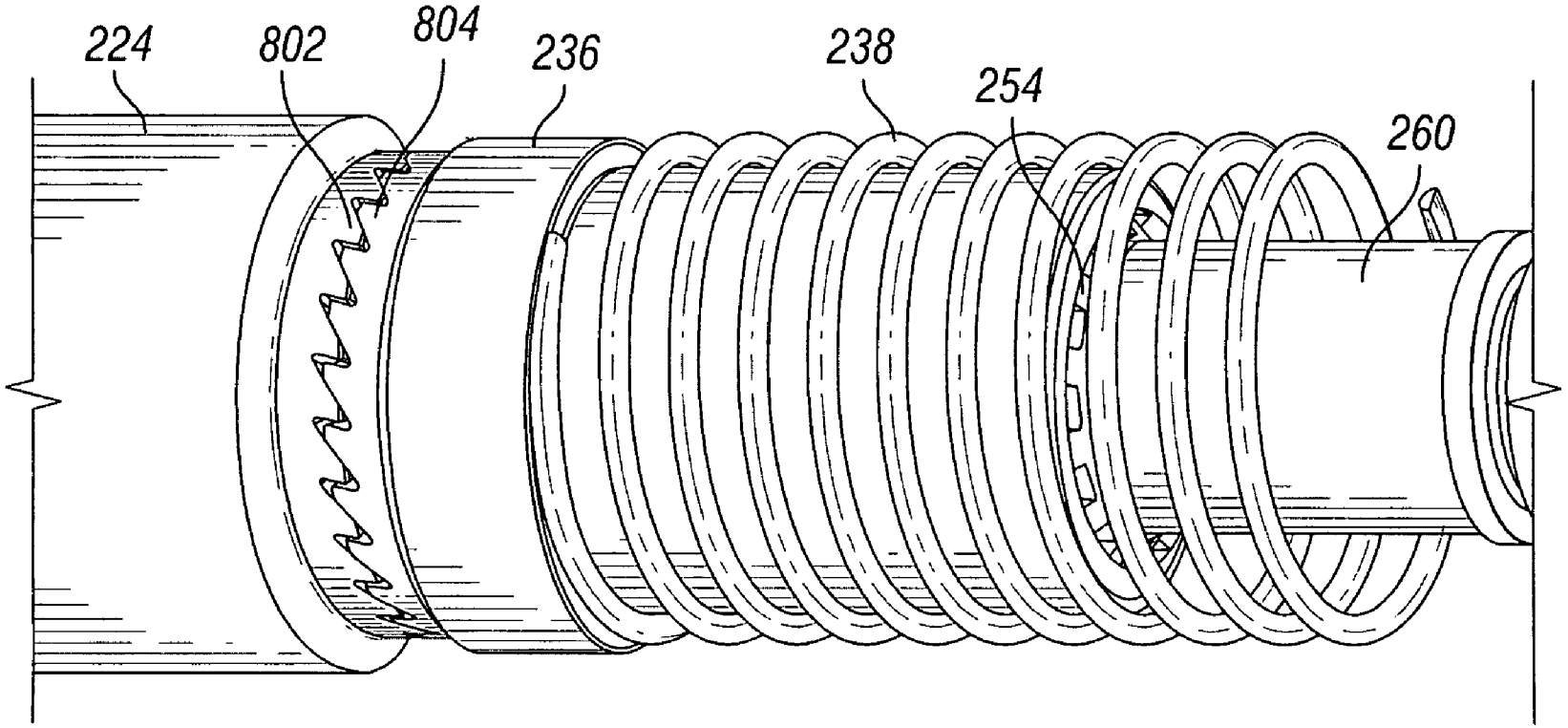
FIG. 9 is a partial perspective view of an orienting apparatus in accordance with an embodiment of the invention.

As shown in FIG. 9, a plurality of teeth 804 disposed on an upper surface of lower clutch 236 engage a plurality of teeth 802 formed on a lower surface of lower body 224. The plurality of teeth 802 and 804 are biased so that when engaged, the lower clutch 236 may move in one direction. For example, in one embodiment, as mandrel 260 is rotated in a clockwise direction, and lower clutch 236 moves in a clockwise direction due to engagement of straight splines 254 with corresponding grooves 808. As the lower clutch 236 moves in a clockwise direction, the plurality of teeth 804 of the lower clutch 236 move past the plurality of teeth 802 of lower body 224. However, in this embodiment, movement of lower clutch 236 in a counter-clockwise direction is limited due to biasing of the plurality of teeth 804, 802. One of ordinary skill in the art will appreciate that other clutch mechanisms may be used without departing from the scope of the invention.

The spacing of the plurality of teeth 802, 804 may be selected in order to set the amount of rotation of the mandrel. A degree of rotation of the mandrel 260 may be pre-selected by selecting the number of teeth on lower clutch 236 and lower body 224. For example, 24 teeth disposed on lower clutch 236 and 24 teeth disposed on lower body 224 may provide 15 degrees of rotation for every tooth. In another example, 18 teeth disposed on lower clutch 236 and lower body 224 may provide 20 degrees of rotation for every tooth. One of ordinary skill in the art with appreciate that the degree of rotation required and the corresponding number of teeth provided on lower clutch 234 and lower body 224 may be selected based on a desired direction of the wellbore being drilled.

Referring back to FIG. 2, the bottom sub 222 is disposed below the end cap 220 and coupled to a lower end of mandrel 260. Thus, as the mandrel 260 rotates, the bottom sub 222 rotates. In one embodiment, a bent sub (not shown) may be coupled to a lower end of the bottom sub 222, thereby causing rotation of the bent sub. In another embodiment, a collar, a positive displacement motor, floating subs, downhole pressure subs, or other downhole tools may be coupled to the lower end of bottom sub 222. One of ordinary skill in the art will appreciate that the bottom sub 222 may be coupled to the mandrel 260 by any method known in the art. For example, the bottom sub 222 may be threadedly engaged with mandrel 260.

OPERATION

FIG. 2 shows the orienting apparatus 25 in a non-activated position. In one embodiment, the orienting apparatus 25 may be actuated from the surface by delivering hydraulic fluid from the surface down through a central passage in the drill string and to a central passage of the orienting apparatus 25. The pressure drop across nozzle 211 moves the piston 212 downward, thereby activating the orienting apparatus 25.

In one embodiment, fluid is flowed through an interchangeable nozzle 211 disposed in a central passage of the orienting apparatus 25, thereby causing a differential pressure. Piston 212 coupled to torque generator 230 moves downward as a result of the differential pressure. As the torque generator 230 moves and rotates downward until a stop 626 disposed in a lower end of the torque generator 230 contacts an upper surface 618 of stroke adjuster 250. Mandrel 260, coupled to torque generator 230, rotates as a result of the coupling.

As piston 212 moves downward, it moves torque generator 230 downward and compresses piston return spring 232 between a lower surface of piston 212 and upper body 214. In the embodiment shown in FIG. 2, helical splines 218 force torque generator 230 to rotate in a clockwise direction. In one embodiment, by selecting a nozzle 211 based on the type of fluid pumped through the orienting apparatus 25 and a pump rate of the fluid, the torque output of the torque generator may be approximately 3,000 ft-lbs. The nozzle 211 may be selected in accordance with a desired torque output to be generated by the orienting apparatus 25. For example, the nozzle 211 may be selected based on the type of fluid used to activate the orienting apparatus 25 and the pump rate at which the fluid is pumped through the nozzle 211. Depending on, for example, the density and/or the viscosity of the fluid delivered through nozzle 211 at a given flow rate, a nozzle 211 may be selected so as to provide a sufficient differential pressure across the nozzle 211 for a desired torque output of the orienting apparatus 25. Accordingly, the torque output by the orienting apparatus 25 may be varied by changing the nozzle 211 coupled to piston 212.

Torque generator 230 moves downward until stop 626 contact upper surface 618 of stroke adjuster 250. As piston 212 and torque generator 230 move downward, upper clutch 234 moves downward. Upper clutch spring 244 compresses between a lower surface of upper clutch 234 and an upper surface of lower body 224. Engagement of the plurality of teeth 270 on torque generator 230 and plurality of teeth 272 on upper clutch 234 causes the upper clutch 234 to rotate in a clockwise direction. Straight splines 252 disposed on an outside diameter of upper end of mandrel 260 allow upper clutch 234 to move downward along the mandrel and rotate the mandrel 260 in accordance with the rotation of torque generator 230, thereby rotating bottom sub 222.

As mandrel 260 rotates, lower clutch 236 rotates in a corresponding clockwise direction due to engagement of straight splines 254 disposed on an outside diameter on a lower end of mandrel 260 and corresponding grooves 808 of lower clutch 236. As the lower clutch 236 rotates, the plurality of teeth 804 move past the plurality of teeth 802 disposed on a lower surface of lower body 224.

The degree of rotation of the bottom sub 222 is determined by the stroke of the piston 212 and torque generator 230, in combination with the design of the plurality of teeth 272 of lower clutch 236. The stroke of the piston 212 and torque generator 230 is limited by the stroke adjuster 250. The axial length of space 25 corresponds to a degree of rotation of mandrel 260, such that the plurality of teeth 804 of lower clutch 236 rotates over the plurality of teeth 802 of lower body 224. For example, in one embodiment, the plurality of teeth 804 of lower clutch 236 includes 24 teeth spaced 15 degrees apart. In this example, stroke adjuster 250 is threaded inside mandrel 260 until lower surface 620 of stroke adjuster 250 contacts shoulder 622 of mandrel 260. In this embodiment, the axial length of space 25 corresponds to a rotational displacement of two pitches of the plurality of teeth 804 of the lower clutch 236. Accordingly, the torque generator 230 moves downward an axial length of space 25 until stop 626 contacts upper surface 618 of stroke adjuster 250. Simultaneously rotation of torque generator 230 forces rotation of mandrel 260, thereby rotating lower clutch 236 through two pitches of the plurality of teeth 804.

In another embodiment, the stroke adjuster 250 may be threaded inside mandrel 260 approximately half the distance of the previous example. Thus, the axial length of space 25 is reduced approximately in half. Accordingly, in this embodiment, the axial length of space 25 corresponds to a rotational displacement of one pitch of the plurality of teeth 804 of the lower clutch 236. Thus, as torque generator 230 moves downward an axial length of space 25 until stop 626 contacts upper surface 618 of stroke adjuster 250, simultaneously rotation of torque generator 230 forces rotation of mandrel 260. Rotation of mandrel 260 causes a rotational displacement of one pitch of the plurality of teeth 804 of lower clutch 236.

Thus, the degree of rotation of the bottom sub, and subsequently azimuthal angle of the drill bit, is adjustable by positioning stroke adjuster 250 inside mandrel 260 to provide a pre-determined axial length of space 625 to correspond with a degree of rotation of mandrel 260. One of ordinary skill in the art will appreciate that the location of the stroke adjuster 250, and therefore, the axial length of space 625, may be selected based on the desired direction to be drilled, formation properties, drilling equipment, etc. One of ordinary skill in the art will also appreciate that the number of teeth and degree of separation of the teeth 804 on the lower clutch 236 may vary. For example, the stroke adjuster 250 may inserted in mandrel 260 so that axial length of space 625 corresponds with a rotational displacement of one pitch, two pitches, three pitches, etc. of the plurality of teeth 804 of lower clutch 236. Further, the number of teeth 804 of lower clutch 236 may be selected to correspond with a desired degree of rotation. For example, 36 teeth may correspond to rotational displacements in increments of 10 degrees, 24 teeth may correspond to rotational displacements in increments of 15 degrees, 18 teeth may correspond to rotational displacements in increments of 20 degrees, etc.

One of ordinary skill in the art will appreciate that the stroke of the torque generator 230 may be adjusted by threading or un-threading the stroke adjuster 250 inside mandrel 260. Further, one of ordinary skill in the art will appreciate that the stroke adjuster 250 may be coupled to the mandrel 260 by any method know in the art. In this embodiment, stroke adjuster 250 is threadedly engaged with mandrel 260, however, stroke adjuster 250 may be coupled by bolts, adhesive, or other locking devices known in the art.

To reset the orientation apparatus 25, the fluid flow through the orientation apparatus 25 is reduced or stopped, thereby reducing the pressure differential across nozzle 211. Piston return spring 232 moves piston 212, and therefore, torque generator 230, upward, back to an initial position. Thrust bearings 240 are provided between piston return spring 232 and upper body 214 to help move the piston 212 and torque generator 230 upward. Because of the biasing of the plurality of teeth 270, 272 of torque generator 230 and upper clutch 234, respectively, torque generator 230 is allowed to rotate in a counter-clockwise direction as it moves upward. Upper clutch spring 244 moves upper clutch 252 upward. Engagement of the plurality of teeth 802, 804 of lower body 224 and lower clutch 236 limit counter-clockwise rotation of mandrel 260 and bottom sub 222. Thus, mandrel 260 and bottom sub 222 remain in a rotated position while the orienting tool 25 is reset. Increasing the differential pressure again across nozzle 211 provide further rotation of mandrel 260 and bottom sub 222. The above mentioned cycle may be repeated until the desired turning of a bent sub or other downhole tool has been reached.

Advantageously, the present invention may provide improved directional control when drilling in a lateral or azimuthal direction from the vertical. Embodiments of the present invention may provide adjustable torque output of an orienting apparatus.

Embodiments of the present invention may provide controlled, incremental rotation of an orienting apparatus.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. An orienting apparatus comprising:

at least one housing element configured to couple with a drill string;

an actuator disposed inside the at Least one housing element;

a nozzle coupled to the actuator;

a torque generator coupled to the actuator and extending axially downward through the at least one housing, wherein the torque generator is configured to rotate in a first direction as it moves downward;

a mandrel coupled to the torque generator, wherein rotation of the torque generator in the first direction causes rotation of the mandrel; and a stroke adjuster at least partially disposed in an upper end of the mandrel, wherein rotation in the first direction is caused by an increase in differential pressure across the nozzle.

2. The orienting apparatus of claim 1, further comprising:

an upper clutch coupled to the torque generator and configured to rotate the mandrel disposed radially inside the upper clutch in response to rotation of the torque generator;

a lower clutch configured to maintain a rotational position of the mandrel when the torque generator rotates in a second direction, wherein rotation in the second direction is caused by a decrease in differential pressure.

3. The orienting apparatus of claim 1, further comprising a bottom sub disposed axially below the at least one housing element and coupled to a lower end of the mandrel.

4. The orienting apparatus of claim 1, wherein the nozzle is interchangeable.

5. The orienting apparatus of claim 1, wherein a stop formed in a lower end of the torque generator is configured to contact an upper surface of the stroke adjuster.

6. The orienting apparatus of claim 5, wherein a position of the stroke adjuster inside the mandrel is adjustable such that an axial length between the stop and the upper surface of the stroke adjuster is varied.

7. The orienting apparatus of claim 1, wherein the torque generator comprises helical splines disposed on an outside diameter configured to engage corresponding helical grooves disposed on an inside diameter of at least one housing element.

8. The orienting apparatus of claim 2, wherein the mandrel comprises straight splines disposed on an outside diameter configured to engage corresponding grooves on an inside diameter of the upper clutch.

9. The orienting apparatus of claim 2, wherein the torque generator comprises a plurality of teeth disposed on a lower surface configured to engage a plurality of teeth disposed on an upper surface of the upper clutch, such that, the plurality of teeth of the torque generator rotationally move the plurality of teeth of the upper clutch as the torque generator rotates in the first direction.

10. The orienting apparatus of claim 2, wherein straight splines disposed on an outside diameter of a lower end of the mandrel engage corresponding grooves disposed on an inside diameter of the lower clutch are configured to rotate the lower clutch when the mandrel rotates in a first direction.

11. The orienting apparatus of claim 10, wherein the lower clutch comprises a plurality of teeth disposed on an upper surface configured to engage a plurality of teeth disposed on a lower surface of a lower body.

12. The orienting apparatus of claim 11, wherein the plurality of teeth disposed on the lower clutch and the lower body are biased in one direction.

13. The orienting apparatus of claim 1, further comprising a return spring configured to move the actuator axially upward when the pressure differential is reduced.

14. The orienting apparatus of claim 13, further comprising at least one thrust bearing disposed between the return spring and an upper body.

15. The orienting apparatus of claim 1, wherein the nozzle is threadedly engaged with the actuator.

16. A method of operating an orienting apparatus comprising:

flowing fluid through an interchangeable nozzle disposed in a central passage of the orienting apparatus, thereby causing a differential pressure;

moving a piston coupled to a torque generator downward as a result of the differential pressure, wherein the torque generator rotates as it moves downward, and wherein the torque generator is moved downward until a stop disposed in a lower end of the torque generator contacts an upper surface of a stroke adjuster; and rotating a mandrel coupled to the torque generator, wherein rotation of the torque generator causes the mandrel to rotate.

17. The method of claim 16, wherein the rotating a mandrel coupled to the torque generator comprises engaging a plurality of teeth on a Lower surface of the torque generator with a plurality of teeth on an upper surface of an upper clutch, wherein the upper clutch is coupled to an upper end of the mandrel, and rotating the upper clutch.

18. The method of claim 16, further comprising:

reducing the differential pressure;

limiting rotation of the mandrel; and moving the piston and the torque generator upward, wherein the torque generator rotates as it moves upward.

19. The method of claim 18, wherein the limiting rotation of the mandrel comprises engaging a plurality of teeth disposed on an upper surface of a lower clutch with a plurality of teeth disposed on a lower surface of a lower body, wherein the plurality of teeth of the lower clutch and the lower body are biased in one direction.

20. The method of claim 16, wherein the piston is moved upward by a piston return spring.

* * * * *